US008177573B2

(12) United States Patent
Deno et al.

(10) Patent No.: US 8,177,573 B2
(45) Date of Patent: May 15, 2012

(54) WATERPROOF PLUG AND WIRING HARNESS HAVING THE SAME

(75) Inventors: Masahiro Deno, Makinobara (JP); Tomokazu Yamane, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/203,132

(22) PCT Filed: Jan. 18, 2010

(86) PCT No.: PCT/JP2010/050856

§ 371 (c)(1),
(2), (4) Date: Aug. 24, 2011

(87) PCT Pub. No.: WO2010/100974

PCT Pub. Date: Sep. 10, 2010

(65) Prior Publication Data

US 2011/0312201 A1 Dec. 22, 2011

(30) Foreign Application Priority Data

Mar. 5, 2009 (JP) ..... 2009-052047

(51) Int. Cl.
*H01R 13/52* (2006.01)

(52) U.S. Cl. ..... 439/274

(58) Field of Classification Search ..... 439/274, 439/278, 587, 588

See application file for complete search history.

(56) References Cited

U.S. PATENT DOCUMENTS 5,927,725 A * 7/1999 Tabata et al. ..... 277/607
6,132,249 A * 10/2000 Saito et al. ..... 439/587
6,152,752 A * 11/2000 Fukuda ..... 439/275
6,309,252 B1 * 10/2001 Murakami et al. ..... 439/587
6,814,617 B2 * 11/2004 Oota et al. ..... 439/589
2006/0019535 A1 1/2006 Fukushima et al.
2008/0318473 A1 * 12/2008 Morikawa et al. ..... 439/588
2009/0130901 A1 * 5/2009 Aoki et al. ..... 439/587

FOREIGN PATENT DOCUMENTS

JP 1-121276 8/1989
JP 4-124775 11/1992
JP 2006-032199 A 2/2006

OTHER PUBLICATIONS

International Search Report for International Application No. PCT/JP2010/050856 issued Sep. 9, 2010.

* cited by examiner

*Primary Examiner* — Tulsidas C Patel
*Assistant Examiner* — Phuongchi Nguyen
(74) *Attorney, Agent, or Firm* — Edwards Wildman Palmer LLP

(57) ABSTRACT

A waterproof plug, which is mounted around an electric wire connected with a terminal to be received in a terminal receiving section of a connector housing, and waterproofs between an inner wall of the terminal receiving section and the electric wire, includes a waterproof member made of elastic material having a cylindrical main body, a plurality of inner lips projecting inwardly from an inner surface of the main body, and a plurality of outer lips projecting outwardly from an outer surface of the main body; and a resin member made of synthetic resin, having a cylindrical portion and a plurality of internal portions projecting from an end of the cylindrical portion along an axis of the cylindrical portion, and the plurality of internal portions is arranged with a distance between each other around the cylindrical portion and arranged in the main body of the waterproof member.

2 Claims, 6 Drawing Sheets

WATERPROOF PLUG AND WIRING HARNESS HAVING THE SAME

CROSS-REFERENCE TO RELATED APPLICATIONS

This application is the national stage of International Application No. PCT/JP2010/050856, filed Jan.18, 2010, which application claims priority to Japanese Patent Application No.: 2009-052047, filed Mar.5, 2009, the contents of which are incorporated herein by reference.

TECHNICAL FIELD

This invention relates to a waterproof plug waterproofing between an inner wall of a terminal receiving section of a connector housing and an electric wire in the connector housing structuring a wiring harness, and the wiring harness having the waterproof plug.

BACKGOUND ART

The wiring harness includes a connector housing made of synthetic resin, an electric wire and a terminal joined with the electric wire and received in the connector housing. The wiring harness fits to a mating connector housing, so that the terminal in the connector housing is electrically connected with a terminal in the mating connector housing.

Some of the wiring harness includes a waterproof plug, which waterproofs between an inner wall of the terminal receiving section and the electric wire to prevent from water penetrating into the terminal receiving section (Refer Patent Document 1: Japan Patent Application published No. 2006-32199).

FIG. 10 is an illustration explaining problems of the waterproof plug by prior art. The waterproof plug 101 shown in FIG. 10 includes a waterproof member 103 made of an elastic material and a resin member 103 made of synthetic resin. The waterproof member 103 includes a cylindrical main body 130, a plurality of outer lips 131 projecting outwardly from an outer surface of the main body 130 surrounding the main body 130, and a plurality of inner lips 132 projecting inwardly from an inner surface of the main body 130 surrounding the main body 130. The resin member 102 includes a cylindrical internal portion 121 and an exposed portion 120 exposed outwardly.

The waterproof plug 101 structured above is received in the terminal receiving section of the connector housing together with an electric wire 106 after mounting around the electric wire 106 so as to insert the electric wire 106 inside the main body 130. The lips 131 are pressed and deformed on the inner wall of the terminal receiving section so as to waterproof between the inner wall and it. The lips 132 are pressed and deformed on the electric wire 106 and the inner wall so as to waterproof between the electric wire 106 and it. The resin member 102 is provided for preventing deformation by aged deterioration and for reinforcing the waterproof member 103.

SUMMARY OF INVENTION

Objects to be Solved

The waterproof plug 101 by Prior Art has a following problem: when inserting the electric wire 106 inside the main body 130, the electric wire 106 touches a top of the lip 132 and the lip 132 may be deformed outwardly. The internal portion 121 reacts against the deformation of the lips 132, and friction force between the lips 132 and the electric wire 106 increases. Thereby, it results a problem that an insertion force of inserting the electric wire 106 through the main body 130 increases.

According to the above problems, an object of the present invention is to provide a waterproof plug, which can prevent deformation by aged deterioration and improve stiffness and decrease an insertion force on assembling a wiring harness and to provide the wiring harness having the waterproof plug.

How to Attain the Object of the Present Invention

In order to overcome the above problems and attain the object of the present invention, a waterproof plug, which is mounted around an electric wire connected with a terminal to be received in a terminal receiving section of a connector housing, and waterproofs between an inner wall of the terminal receiving section and the electric wire, includes a waterproof member made of elastic material, the waterproof member having a cylindrical main body, a plurality of inner lips projecting inwardly from an inner surface of the main body and surrounding the main body, and a plurality of outer lips projecting outwardly from an outer surface of the main body and surrounding the main body; and a resin member made of synthetic resin, the resin member having a cylindrical portion and a plurality of internal portions projecting from an end of the cylindrical portion along an axis of the cylindrical portion, the plurality of internal portions being arranged with a distance between each other around the cylindrical portion and being arranged in the main body.

According to the present invention, a wiring harness includes a connector housing having a terminal receiving section, an electric wire, a terminal joined to an end of the electric wire and received in the terminal receiving section, a waterproof plug, which is mounted around the electric wire and waterproofs between an inner wall of the terminal receiving section and the electric wire, the waterproof plug including a waterproof member made of elastic material, the waterproof member having a cylindrical main body, a plurality of inner lips projecting inwardly from an inner surface of the main body and surrounding the main body, and a plurality of outer lips projecting outwardly from an outer surface of the main body and surrounding the main body; and a resin member made of synthetic resin, the resin member having a cylindrical portion and a plurality of internal portions projecting from an end of the cylindrical portion along an axis of the cylindrical portion, the plurality of internal portions being arranged with a distance between each other around the cylindrical portion and being arranged in the main body.

Effects of Invention

According to the present invention, since the waterproof plug including a waterproof member made of elastic material, the waterproof member having a cylindrical main body, a plurality of inner lips projecting inwardly from an inner surface of the main body and surrounding the main body, and a plurality of outer lips projecting outwardly from an outer surface of the main body and surrounding the main body; and a resin member made of synthetic resin, the resin member having a cylindrical portion and a plurality of internal portions projecting from an end of the cylindrical portion along an axis of the cylindrical portion, the plurality of internal portions being arranged with a distance between each other around the cylindrical portion and being arranged in the main body, when inserting the electric wire through the main body, a part of lip between the internal portions can be deformed outwardly. Thereby, friction force between the lips and the electric wire is reduced totally. Thus, the waterproof plug, which is prevented from deformation by aged deterioration and is reinforced and the insertion force on assembling a wiring harness can be reduced, is provided.

According to the present invention, since the waterproof plug including a waterproof member made of elastic material, the waterproof member having a cylindrical main body, a plurality of inner lips projecting inwardly from an inner surface of the main body and surrounding the main body, and a plurality of outer lips projecting outwardly from an outer surface of the main body and surrounding the main body; and a resin member made of synthetic resin, the resin member having a cylindrical portion and a plurality of internal portions projecting from an end of the cylindrical portion along an axis of the cylindrical portion, the plurality of internal portions being arranged with a distance between each other around the cylindrical portion and being arranged in the main body, when inserting the electric wire through the main body, a part of lip between the internal portions can be deformed outwardly. Thereby, friction force between the lips and the electric wire is reduced totally. Thus, the wiring harness, which is prevented from deformation by aged deterioration and is reinforced and the insertion force on assembling a wiring harness can be reduced, is provided.

The above and other objects and features of this invention will become more apparent from the following description taken in conjunction with the accompanying drawings.

DESCRIPTION OF EMBODIMENT

Figure 1:
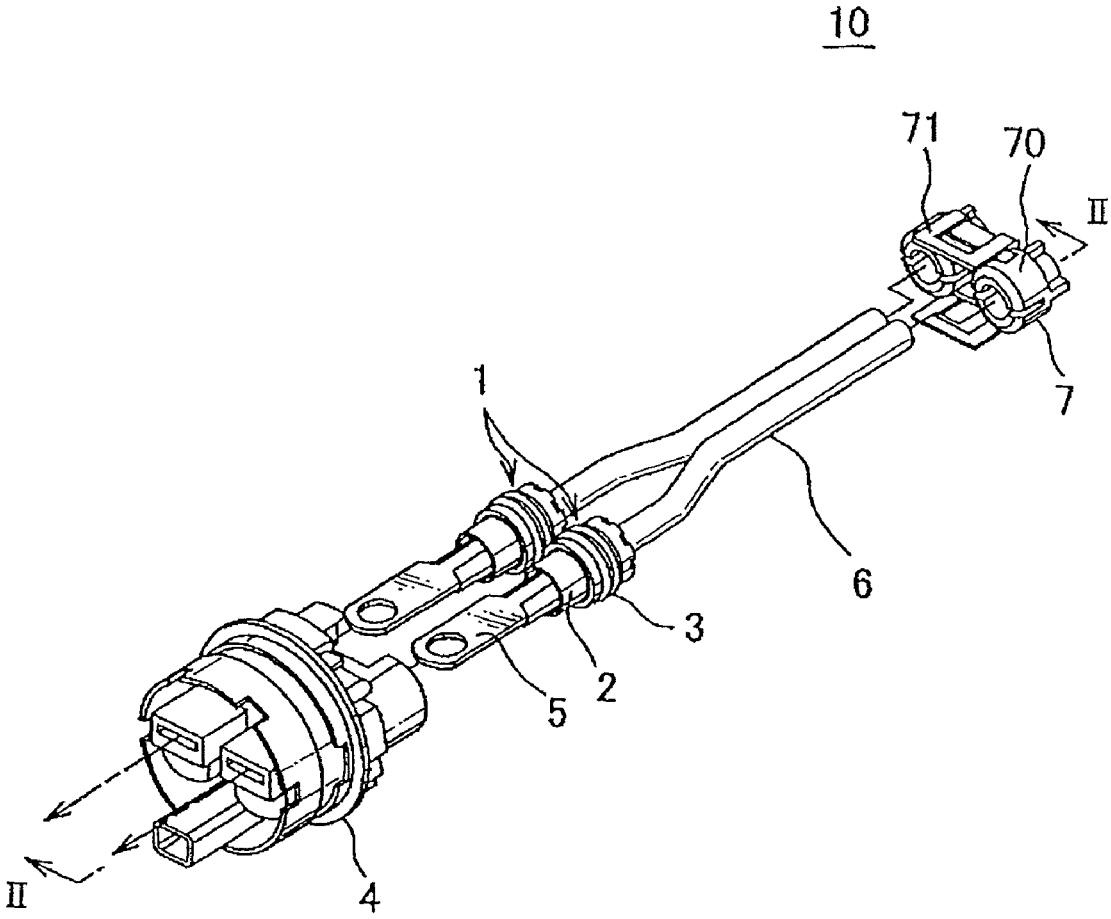
FIG. 1 is a perspective view of a wiring harness having a waterproof plug of one embodiment according to the present invention.
Figure 2:
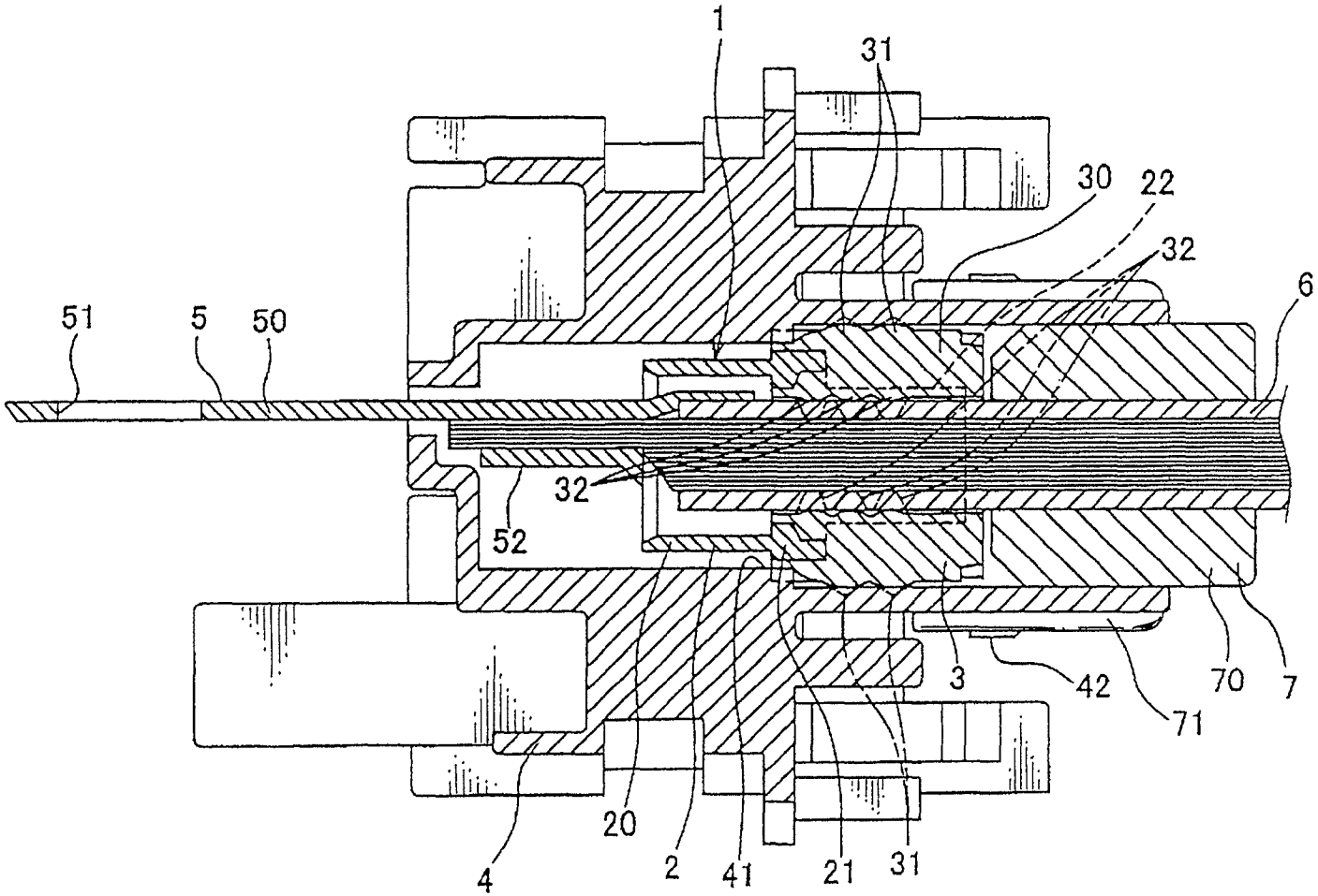
FIG. 2 is a cross sectional view taken along the line II-II in FIG. 1.
Figure 3:
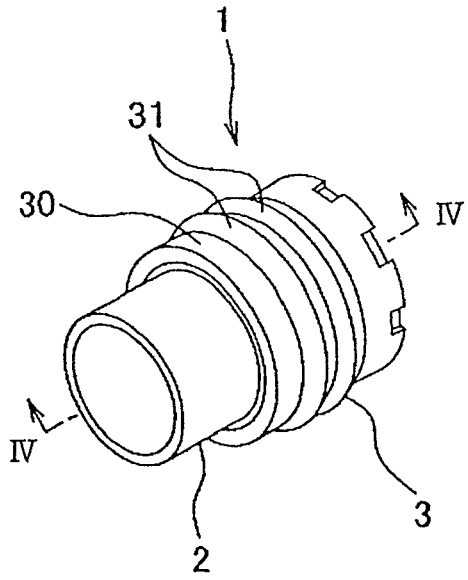
FIG. 3 is a perspective view of the waterproof plug shown in FIG. 1.
Figure 4:
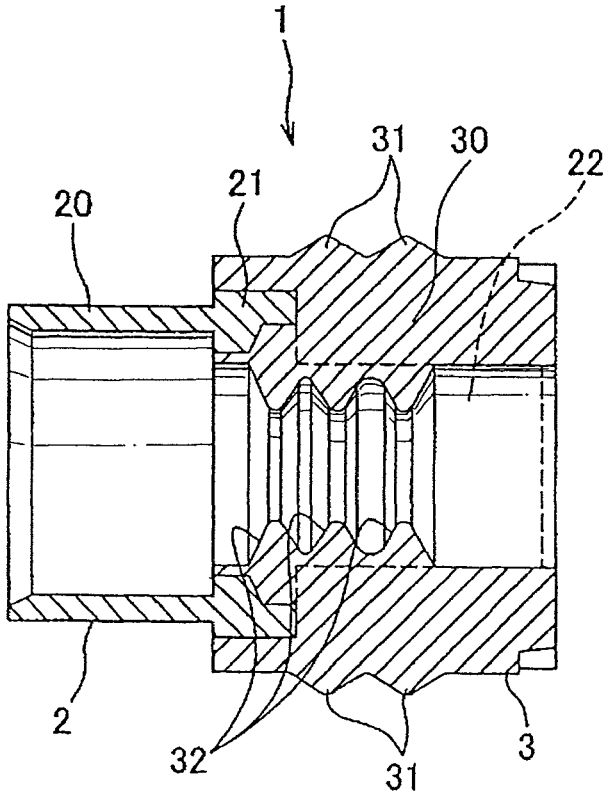
FIG. 4 is a cross sectional view taken along the line IV-IV in FIG. 3.
Figure 5:
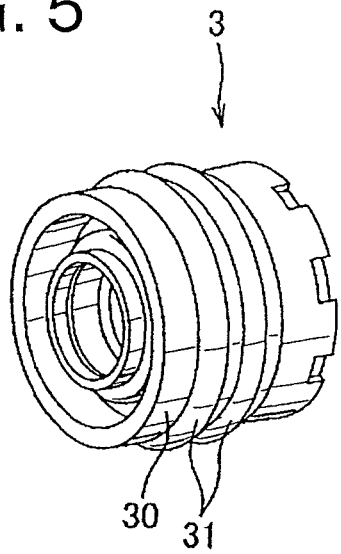
FIG. 5 is a perspective view of a waterproof member structuring the waterproof plug shown in FIG. 3.
Figure 6:
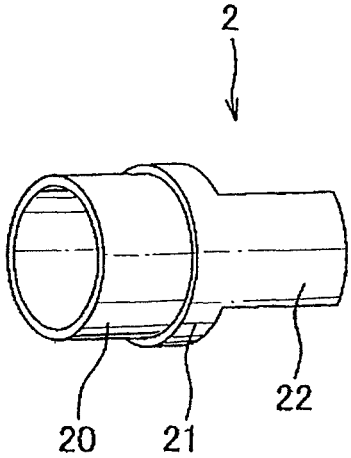
FIG. 6 is a perspective view of a resin member structuring the waterproof plug shown in FIG. 3.
Figure 7:
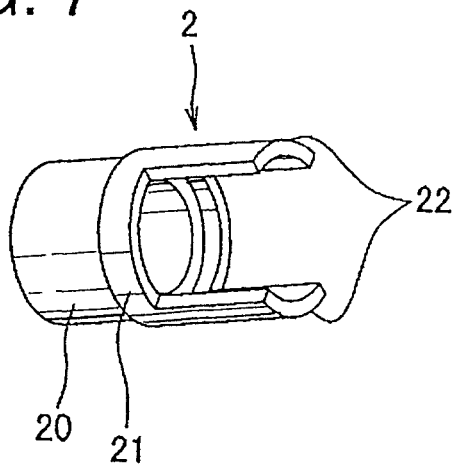
FIG. 7 is a perspective view of the resin member shown in FIG. 6 when viewed from a different direction.
Figure 8:
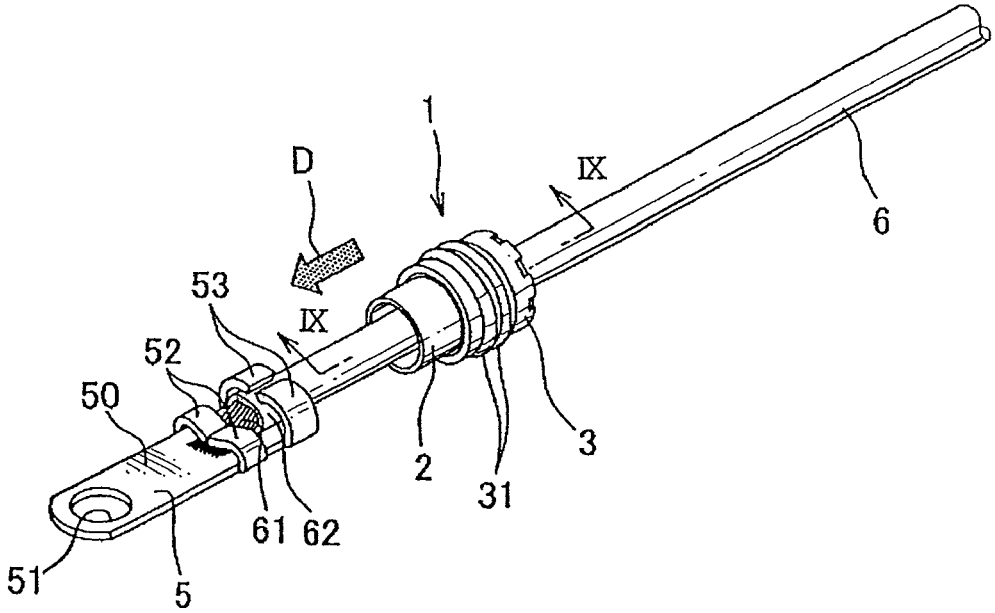
FIG. 8 is an illustration of assembling the waterproof plug shown in FIG. 3 to the electric wire.
Figure 9:
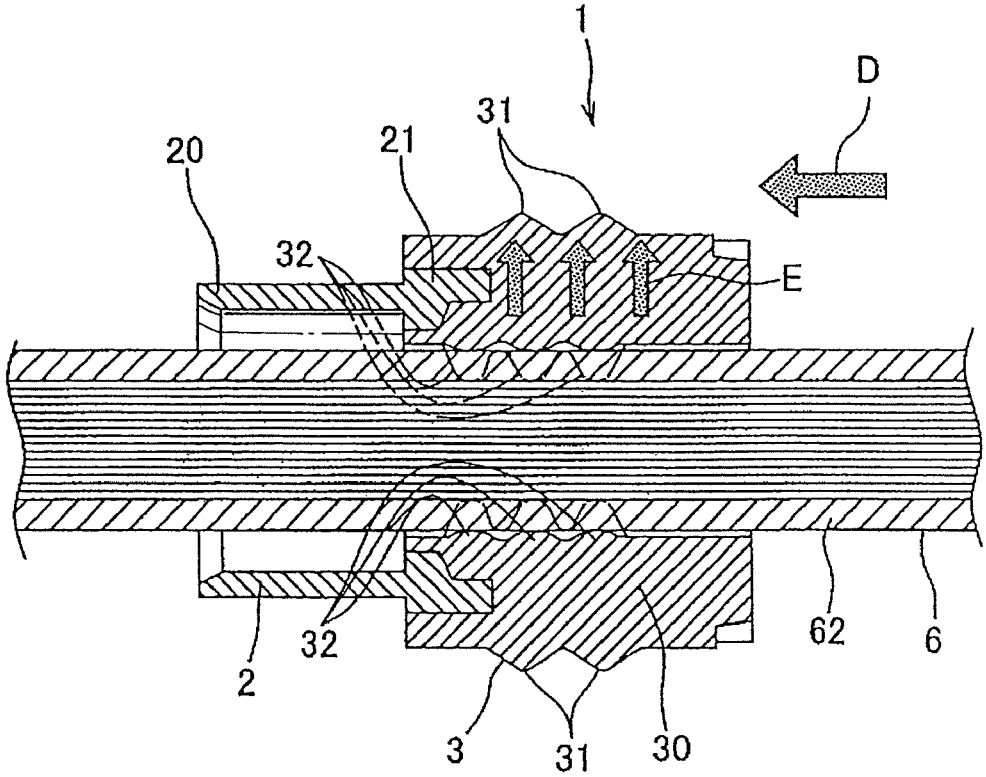
FIG. 9 is a cross sectional view taken along the line IX-IX in FIG. 8.
Figure 10:
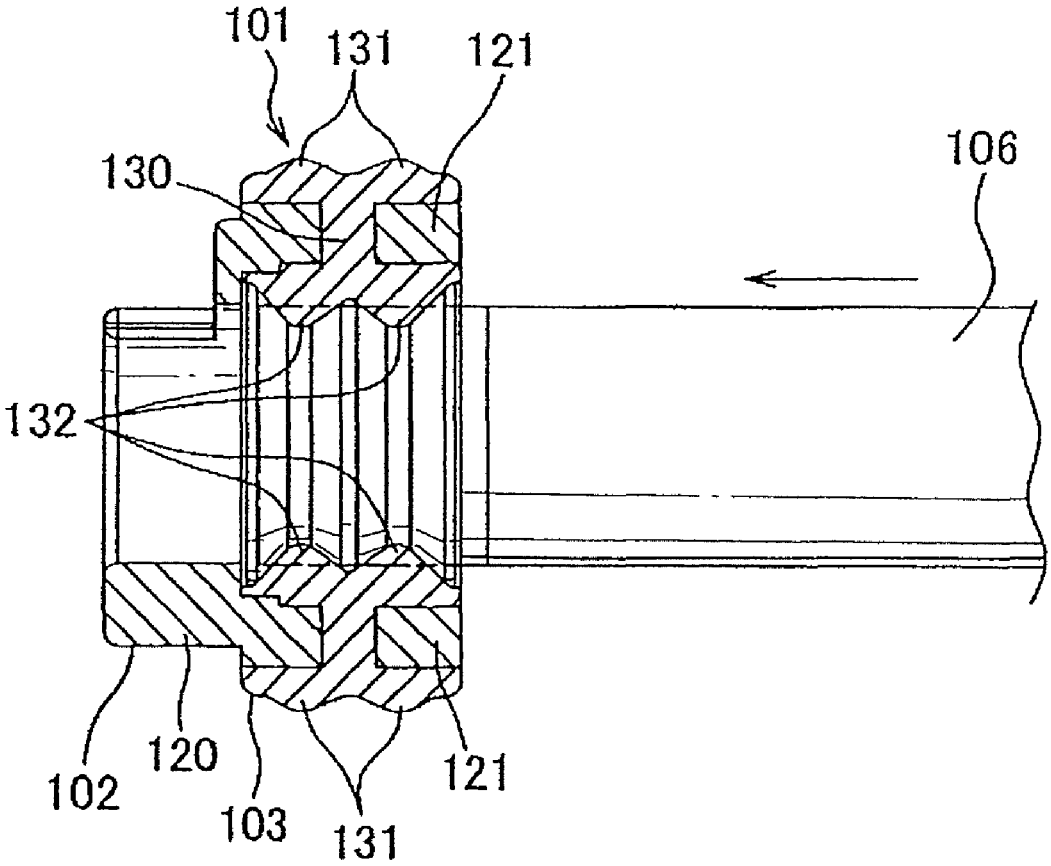
FIG. 10 is an illustration showing a problem of a waterproof plug by prior art.

A waterproof plug and a wiring harness having the waterproof plug of embodiments according to the present invention will be described with reference to FIGS. 1-9. FIG. 1 is a perspective view of the wiring harness having the waterproof plug according to the present invention. FIG. 2 is a cross sectional view taken along the line in FIG. 1. FIG. 3 is a perspective view of the waterproof plug shown in FIG. 1. FIG. 4 is a cross sectional view taken along the line IV-IV in FIG. 3. FIG. 5 is a perspective view of a waterproof member structuring the waterproof plug shown in FIG. 3. FIG. 6 is a perspective view of a resin member structuring the waterproof plug shown in FIG. 3. FIG. 7 is a perspective view of the resin member shown in FIG. 6 when viewed from a different direction. FIG. 8 is an illustration of assembling the waterproof plug shown in FIG. 3 to the electric wire. FIG. 9 is a cross sectional view taken along the line IX-IX in FIG. 8.

As shown in FIGS. 1, 2, the waterproof plug 1 according to the present invention is for waterproofing between an inner wall of the terminal receiving section 41 and the electric wire 6 in the terminal receiving section 41 of the connector housing 4 forming the wiring harness 10.

The wiring harness 10 includes the connector housing 4 made of synthetic resin having the terminal receiving section 41, the electric wire 6, a terminal 5 joined with an end of the electric wire 6 and received in the terminal receiving section 41, the waterproof plug 1 mounted around the electric wire 6 and waterproofing between an inner wall of the terminal receiving section 41 and the electric wire 6, and a holder 7 preventing the terminal 5 from dropping out of the terminal receiving section 41.

The electric wire 6 is a covered wire with a round section having an electric conductive core wire 61 covered around it with an insulation cover 62 as shown in FIG. 8. The insulation cover 62 of the electric wire 6 is peeled at an end of the electric wire 6 so as to expose the core wire 61.

The terminal 5 is formed by pressing an electric conductive metal sheet. The terminal 5 includes a plate-shaped flat portion 50, a hole 51 arranged at one end of the flat portion 50, a pair of holding pieces 53 arranged at the other end of the flat portion 50, and a pair of joining pieces 52 arranged between the hole 51 and the holding pieces 53. The one end of the flat portion 50 is electrically connected to a not-shown mating terminal. The pair of holding pieces 53 projects vertically from the both side edges of the flat portion 50 for clamping the insulation cover 62 of the electric wire 6 at the end thereof. The pair of joining pieces 52 projects vertically from the both side edges of the flat portion 50 for electrically joining to the core wire 61 by crimping the core wire 61 exposed at the end of the electric wire 6.

As shown in FIGS. 3-7, the waterproof plug 1 includes a waterproof portion 3 made of synthetic rubber as the elastic material, and a resin portion 2 made of synthetic resin.

A shown in FIG. 4, the waterproof portion 3 includes integrally a cylindrical main body 30, a plurality of inner lips 32 projecting inwardly from an inner surface of the main body 30 and arranged around the main body 30, and a plurality of outer lips 31 projecting outwardly from an outer surface of the main body 30 and arranged around the main body 30.

As shown with a solid line in FIG. 2, when the waterproof member 3 is located in the terminal receiving section 41, the plurality of inner lips 32 touches an outer surface of the electric wire 6 and the plurality of outer lips 31 touches the inner wall of the terminal receiving section 41 so that the waterproof member 3 waterproofs between the inner wall of the terminal receiving section 41 and the electric wire 6. Chain double-dashed lines show shapes of the waterproof member 3 before elastic deformation.

As shown in FIGS. 6, 7, the resin portion 2 includes integrally a first cylindrical portion 20, a second cylindrical portion 21 as a cylindrical portion and a plurality of internal portions 22. The first cylindrical portion 20 is formed into a cylindrical shape. The second cylindrical portion 21 formed into a cylindrical shape continuous to one end of the first cylindrical portion 20. The second cylindrical portion 21 has an outer diameter larger than that of the first cylindrical portion 20. The first cylindrical portion 20 and the second cylindrical portion 21 are arranged coaxially. The plurality of internal portions 22 extends from a far end of the second cylindrical portion 21 from the first cylindrical portion 20 along an axial direction of the second cylindrical portion 21.

The plurality of internal portions 22 is arranged with even distances between each other around the second cylindrical portion 21. Each internal portion 22 is formed into a partial cylinder shape. In this embodiment, two internal portions 22 are arranged.

The second cylindrical portion 21 and the plurality of internal portions 22 of such resin member 2 are arranged within the main body 30 at one end of the main body 30 along the axial direction, and the first cylindrical portion 20 is exposed from the main body 30. The waterproof plug 1 is formed by insert-molding by inserting the resin member 2 in a molding die for the waterproof member 3. The first cylindrical portion 20, the second cylindrical portion 21 and the main body 30 are arranged coaxially. The resin member 2 is for preventing the waterproof member 3 from deformation by aged deterioration and for reinforcing the waterproof member 3.

The holder 7 is made of synthetic resin, and includes a pressing portion 70 positioned in the terminal receiving section 41 and a pair of lock portions 71 engaging with each of projections 42 provided at an outer surface of the connector housing 4, as shown in FIGS. 1, 2.

The wiring harness 10 is assembled by the following steps. First, after inserting the electric wire 6 through the waterproof plug 1, the end of the insulation cover 62 is peeled and the core wire 61 is exposed. Thereafter, the terminal 5 is joined to the end of the electric wire 6. Next, as shown in FIGS. 8, 9, the waterproof plug 1 is moved toward the end of the electric wire 5. The electric wire 6 joined with the terminal 5 is inserted into the terminal receiving section 41, and the pressing portion 70 of the holder 7 is inserted into the terminal receiving section 41. The pair of lock portions 71 is engaged with the projections 42 of the connector housing 4, so that the wiring harness 10 is assembled.

According to the present invention, when assembling such wiring harness 10 and inserting the electric wire 6 through the waterproof plug 1, a part of the inner lip 32 between the internal portions 22, that is the part in which the internal portion 22 is not arranged, can be deformed outwardly (shown with allows E) as shown in FIG. 9. Thereby, friction force between the lips 32 and the electric wire 6 is reduced totally. Thus, the waterproof plug 1, which is prevented the waterproof member 3 from deformation by aged deterioration and reinforces the waterproof member 3 and the insertion force on assembling a wiring harness 10 having the waterproof plug 1 can be reduced, is provided.

In the wiring harness 10 according to the present invention, the terminal 5 is held in the terminal receiving section 41 by the waterproof plug 1 and the holder 7, as shown in FIG. 2, and the terminal 5 has no lock structure to the connector housing 4. Thereby, the terminal 5 can be easily removed from the connector housing 4. Thus, the wiring harness according to the present invention has good disassemblability and recyclability.

While, in the embodiment, the present invention is described, it is not limited thereto. Various change and modifications can be made with the scope of the present invention.

The invention claimed is:

1. A waterproof plug, which is mounted around an electric wire connected with a terminal to be received in a terminal receiving section of a connector housing, and waterproofs between an inner wall of the terminal receiving section and the electric wire, the waterproof plug comprising:

a waterproof member made of elastic material, the waterproof member having a cylindrical main body, a plurality of inner lips projecting inwardly from an inner surface of the main body and surrounding the main body, and a plurality of outer lips projecting outwardly from an outer surface of the main body and surrounding the main body; and a resin member made of synthetic resin, the resin member having a cylindrical portion and a plurality of internal portions projecting from an end of the cylindrical portion along an axis of the cylindrical portion, wherein the plurality of internal portions is arranged with a distance between each other around the cylindrical portion and arranged in the main body of the waterproof member.

2. A wiring harness, comprising:

a connector housing having a terminal receiving section;

an electric wire;

a terminal joined to an end of the electric wire and received in the terminal receiving section; and a waterproof plug mounted around the electric wire, the waterproof plug waterproofing between an inner wall of the terminal receiving section and the electric wire, the waterproof plug comprising:

a waterproof member made of elastic material, the waterproof member having a cylindrical main body, a plurality of inner lips projecting inwardly from an inner surface of the main body and surrounding the main body, and a plurality of outer lips projecting outwardly from an outer surface of the main body and surrounding the main body; and a resin member made of synthetic resin, the resin member having a cylindrical portion and a plurality of internal portions projecting from an end of the cylindrical portion along an axis of the cylindrical portion, wherein the plurality of internal portions is arranged with a distance between each other around the cylindrical portion and arranged in the main body.

* * * * *